US006386121B1

(12) United States Patent
Aguilar

(10) Patent No.: US 6,386,121 B1
(45) **Date of Patent: *May 14, 2002**

(54) SAFETY DEPOSIT BOX LOCKING SYSTEM

(76) Inventor: Alfred S. Aguilar, 109 S. 57th Dr., Phoenix, AZ (US) 85043

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 270 days.

(21) Appl. No.: 09/157,670

(22) Filed: Sep. 21, 1998

(51) Int. Cl.[7] ..... E05G 1/00

(52) U.S. Cl. ..... 109/56; 109/67; 70/337; 70/429

(58) Field of Search ..... 70/337, 408, 339, 70/353, 355, 429, 430, 456 R, 158, 63, DIG. 43, DIG. 56; 109/9, 6, 56, 57, 67, 424, 455

(56) References Cited

U.S. PATENT DOCUMENTS

| | | | | | |
|---|---|---|---|---|---|
| 1,293,616 | A | * | 2/1919 | Norton | 70/430 |
| 1,307,253 | A | * | 6/1919 | Griffith | 70/429 |
| 2,524,696 | A | * | 10/1950 | Ellis | 70/339 |
| 3,475,934 | A | * | 11/1969 | Reisner | 70/455 |
| 3,861,182 | A | * | 1/1975 | Skinner | 70/455 |
| 4,118,962 | A | * | 10/1978 | Block et al. | 70/455 |
| 4,297,863 | A | * | 11/1981 | Glock | 70/408 |
| 4,332,153 | A | * | 6/1982 | Miles | 70/339 |
| 4,462,230 | A | * | 7/1984 | Evans | 70/339 |
| 4,516,000 | A | * | 5/1985 | Byberg et al. | 70/408 |
| 4,637,238 | A | * | 1/1987 | Uda et al. | 70/456 R |
| 4,821,542 | A | * | 4/1989 | Rosenthal | 70/454 |
| 5,140,843 | A | * | 8/1992 | Krueger | 70/429 |
| 5,440,909 | A | * | 8/1995 | Ely et al. | 70/408 |
| 5,495,733 | A | * | 3/1996 | Yen et al. | 70/279 |
| 5,701,828 | A | * | 12/1997 | Benore et al. | 109/56 |
| 5,799,522 | A | * | 9/1998 | Ohta | 70/456 R |
| 6,129,029 | A | * | 10/2000 | Watson | 109/56 |

FOREIGN PATENT DOCUMENTS

| | | | |
|---|---|---|---|
| DE | 850 940 | * | 9/1952 |

* cited by examiner

*Primary Examiner*—Teri Pham Luu
(74) *Attorney, Agent, or Firm*—Frank J. McGue

(57) ABSTRACT

An attachment for a door of a safety deposit box cubical for modifying its locking system wherein the locking system comprises a flange forming a part of one of the bank keys extending laterally of the key and anchored to the door for providing access to a safety deposit box by merely using a second assigned key.

1 Claim, 1 Drawing Sheet

SAFETY DEPOSIT BOX LOCKING SYSTEM

BACKGROUND OF THE INVENTION

This invention relates to locking systems for securing safety deposit boxes positioned in a lockable bank vault and more particularly to a plug for retrofitting the present locking system of the vault without structural changes to the locking system of the bank vault.

DESCRIPTION OF THE PRIOR ART

Safety deposit boxes have been extensively used for storing customer valuables in lockable cubicles in the bank vault. Each cubical has a door attached to the bank vault and controlled by two keys, one key being kept in the customer's possession and the other key being used by the bank employee and kept in the bank's possession.

The present use of these locked cubicals require a bank employee to visit the locked cubical with each customer to aid in unlocking or locking it by the customer. Needless to say, the time spent by the bank's employee in providing this service is extensive.

SUMMARY OF THE INVENTION

In accordance with the invention claimed, a new and improved arrangement is provided for modifying the locking system on a cubical door of a bank vault so that the door to the cubical may be opened by the customer without the bank employee being present with his or her key to open or close a particular cubical.

It is, therefore one object of this invention to provide a new and improved means for retrofitting the cubical locking system of a bank vault.

A further object of this invention is to provide a key designed in the form of a plug for insertion in a lock of a bank vault cubical for holding a bank key in unlocked position.

Further objects and advantages of the invention will become apparent as the following description proceeds and the features of novelty which characterize the invention will be pointed out with particularity in the claims annexed to and forming a part of this specification.

BRIEF DESCRIPTION OF THE DRAWING

The present invention may be more readily described by reference to the accompanying drawing in which.

DESCRIPTION OF THE PREFERRED EMBODIMENT

Figure 1:
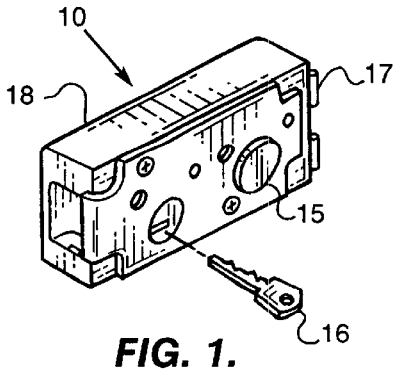
FIG. 1 is a perspective view of a door for opening, closing and locking a safety deposit box cubical formed in a bank vault and embodying the invention.
Figure 2:
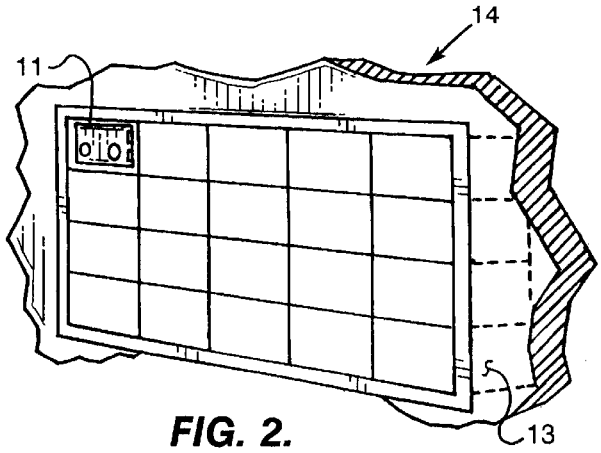
FIG. 2 is a front view of the wall of a bank vault showing a plurality of cubicals found in the bank vault with each cubical furnished for receiving a safety deposit box.

Referring more particularly to the drawing by characters of reference, FIGS. 1 and 2 disclose a door 10, one for each safety deposit box cubical 11 which may be free standing or formed in the wall 13 of a bank vault 14. Each opening with its associated hingedly mounted door forms an individual cubical for receiving a safety deposit box (not shown) the access to the interior of which is controlled by a lock the keys 16 and 15 of which are controlled by the customer and bank employee. respectively.

Each safety deposit box opening 11 is controlled by a door 10 which is hingedly mounted at 17 to the bank vault 14 and forms with it an opening for insertion of a safety deposit box therein the door 10 of which is shown in FIG. 1.

Figure 3:
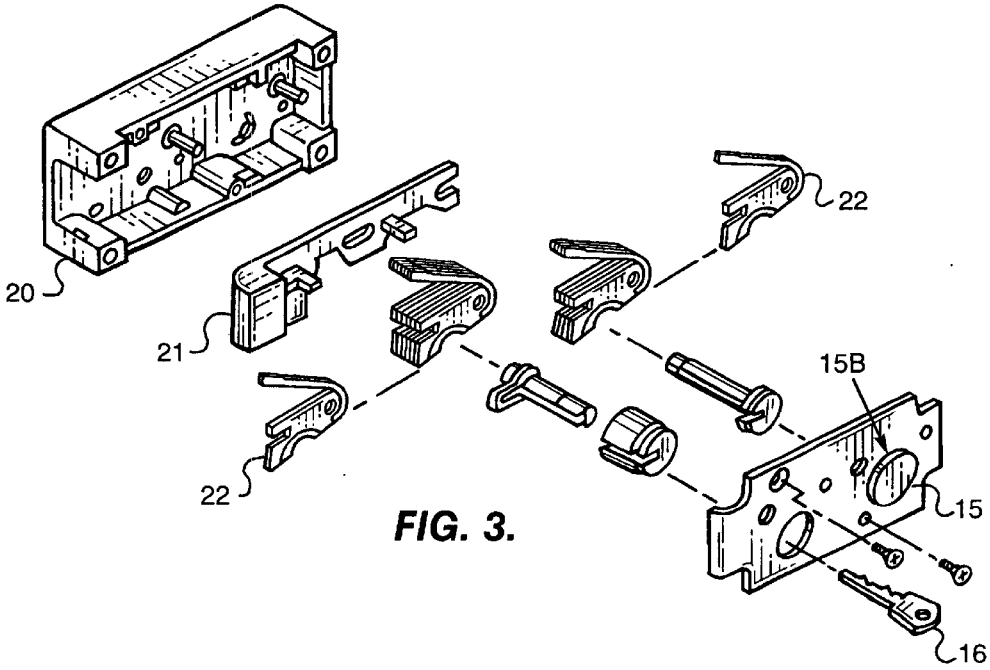
FIG. 3 is an exploded view showing the lock components.
Figure 4:
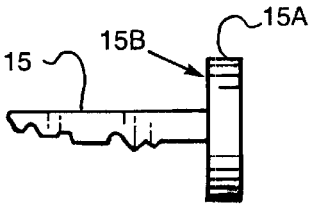
FIG. 4 is a side view of a plug for use in retrofitting a bank vault lock system.
Figure 5:
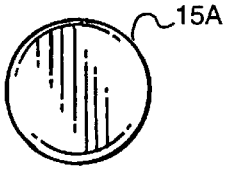
FIG. 5 is a right side view of FIG. 4.

As shown in FIG. 3, the lock for each door 10 comprises a case 20 within which a common bolt 21 is mounted together with a plurality of tumblers 22 one for each locking means controlled individually by keys 15 and 16.

It should be noted that each door of each safety deposit box opening or cubical is controlled by an individual locking mechanism with the locking mechanism shown in FIG. 3 being representative of one of a plurality of different useable locking mechanisms supplied to the marketplace by Diebold, Hamilton and other lock manufacturing companies.

Since it is desirable to simplify the locking mechanism for the doors of the bank vault cubicals by rendering the bank employee's key ineffective without completely overhauling or replacing the total locking structure, the bank employee's key is modified by replacing the normal flat head-of the key and replacing it with a cylindrical cover 15A the longitudinal axis of which is coaxially arranged with the longitudinal axis of the key. Cover 15A and its cam surfaces are rotated until the tumblers of key 15 are in a locked open position. At this point, cover 15A of key 15 is frozen in position by gluing, cementing or the like of the back surface 15B key 15 to the door of the cubical.

At this point, the opening and closing of the door of the safety deposit box is controlled only by key 16, the customer's key.

Thus, the need to replace the door of a cubical containing the safety deposit box is avoided by rendering the banker's key ineffective by a simple plug comprising the combination key 15 and cover or flange 15A.

Although but a single embodiment of the invention has been illustrated and described, it will be apparent to those skilled in the art that various changes and modifications may be made therein without departing from the spirit of the invention or from the scope of the appended claims.

What is claimed is:

1. A storage system for safe keeping of a customer's valuable property, said system including:

(a) a vault;

(b) a plurality of safe deposit boxes stored in said vault and each including;

(i) a first lock mounted in said box, (ii) a first key for opening said first lock;

(iii) a second lock mounted in said box, (iv) a second key inserted in said lock in a fixed position in which said second lock is opened; and, (c) means mounted on each of said safe deposit boxes to engage said second key and permanently maintain said second key in said fixed position.

* * * * *